US010974100B2

(12) United States Patent
Ogawa et al.

(10) Patent No.: US 10,974,100 B2
(45) Date of Patent: Apr. 13, 2021

(54) RACKET AND GROMMET

(71) Applicant: YONEX KABUSHIKI KAISHA, Tokyo (JP)

(72) Inventors: Naoto Ogawa, Niigata (JP); Masato Kawabata, Niigata (JP); Hitoshi Kato, Niigata (JP); Tsutomu Takahashi, Niigata (JP)

(73) Assignee: YONEX KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/306,779

(22) PCT Filed: Apr. 27, 2017

(86) PCT No.: PCT/JP2017/016711
§ 371 (c)(1),
(2) Date: Dec. 3, 2018

(87) PCT Pub. No.: WO2017/208697
PCT Pub. Date: Dec. 7, 2017

(65) Prior Publication Data

US 2019/0126106 A1 May 2, 2019

(30) Foreign Application Priority Data

Jun. 3, 2016 (JP) ..... JP2016-111630

(51) Int. Cl.
*A63B 49/02* (2015.01)
*A63B 49/022* (2015.01)
(Continued)

(52) U.S. Cl.
CPC ..... *A63B 49/022* (2015.10); *A63B 49/02* (2013.01); *A63B 60/006* (2020.08);
(Continued)

(58) Field of Classification Search
CPC ... A63B 49/02; A63B 49/00; A63B 2060/006; A63B 2041/0217; A63B 2041/0211; A63B 2102/02; A63B 2102/04; A63B 2102/06
See application file for complete search history.

(56) References Cited

U.S. PATENT DOCUMENTS 2,282,195 A * 5/1942 Le Compte ..... A63B 49/02 473/547
4,314,699 A * 2/1982 Bayer ..... A63B 49/02 473/544
(Continued)

FOREIGN PATENT DOCUMENTS

CN 2129160 Y 4/1993
CN 1533815 A 10/2004
(Continued)

OTHER PUBLICATIONS

Chinese Office Action regarding corresponding Chinese Appl. No. CN201780034175.6 dated Mar. 10, 2020, 8 pages.
(Continued)

*Primary Examiner* — Raleigh W Chiu
(74) *Attorney, Agent, or Firm* — Brinks Gilson & Lione

(57) ABSTRACT

A racket includes: a grip; an annular frame; and a shaft coupling the grip and the frame together; wherein a projection is provided to an outer peripheral face on a leading end half of the frame in a predetermined range including a location of maximum curvature in a peripheral direction.

2 Claims, 14 Drawing Sheets

(51) Int. Cl.

| | |
|---|---|
| *A63B 60/00* | (2015.01) |
| *A63B 102/02* | (2015.01) |
| *A63B 102/04* | (2015.01) |
| *A63B 102/06* | (2015.01) |

(52) U.S. Cl.
CPC ... *A63B 2049/0217* (2013.01); *A63B 2102/02* (2015.10); *A63B 2102/04* (2015.10); *A63B 2102/06* (2015.10)

(56) References Cited

U.S. PATENT DOCUMENTS

| | | | | |
|---|---|---|---|---|
| 5,009,422 | A * | 4/1991 | Soong | A63B 49/02 473/535 |
| 5,362,071 | A | 11/1994 | Liu | |
| 5,573,242 | A * | 11/1996 | Yoo | A63B 49/02 473/521 |
| 6,958,104 | B1 | 10/2005 | Filippini | |
| 2007/0111830 | A1 * | 5/2007 | Wright | A63B 49/14 473/553 |
| 2010/0331126 | A1 | 12/2010 | Iizawa et al. | |
| 2014/0302952 | A1 * | 10/2014 | Sommer | A63B 49/02 473/521 |
| 2019/0126106 | A1 * | 5/2019 | Ogawa | A63B 49/022 |

FOREIGN PATENT DOCUMENTS

| | | | | |
|---|---|---|---|---|
| CN | 202078710 | U | 12/2011 | |
| EP | 0538523 | A1 * | 4/1993 | A63B 60/54 |
| EP | 0676222 | A1 * | 10/1995 | A63B 60/48 |
| EP | 0676222 | A1 | 11/1996 | |
| EP | 1149607 | A2 * | 10/2001 | A63B 49/10 |
| EP | 2138207 | A1 * | 12/2009 | A63B 49/03 |
| GB | 2393129 | A | 3/2004 | |
| JP | S62-14872 | A | 1/1987 | |
| JP | S63-20865 | | 2/1988 | |
| JP | U0003016909 | | 8/1995 | |
| JP | 3016909 | U | 10/1995 | |
| JP | A1996038652 | | 2/1996 | |
| JP | H8-38652 | A | 2/1996 | |
| JP | A1996155057 | | 6/1996 | |
| JP | H8-155057 | A | 6/1996 | |
| JP | H9-299526 | A | 11/1997 | |
| JP | H09299526 | A | 11/1997 | |
| JP | 2002-282395 | A | 10/2002 | |
| JP | 2002282395 | A | 10/2002 | |
| JP | 2004105558 | A | 4/2004 | |
| JP | 3135523 | U | 9/2007 | |
| JP | 3147573 | U | 1/2009 | |
| JP | 2009-165703 | A | 7/2009 | |
| JP | 2011010746 | A | 1/2011 | |
| JP | 2014-171524 | A | 9/2014 | |
| JP | 2014171524 | A | 9/2014 | |
| JP | 3201966 | U | 1/2016 | |
| JP | 2016-112259 | A | 6/2016 | |
| WO | WO9322005 | A2 | 11/1993 | |
| WO | WO-2007088070 | A2 * | 8/2007 | A63B 49/02 |

OTHER PUBLICATIONS

Japanese Office Action with translation regarding JP2016111630A dated May 12, 2020, 12 pages.
Yonex Release VCORE, TourF93, TourF97, Jan. 16, 2015, 3 pages.
European Search Report and Office Action regarding EP 17 806256 dated Oct. 7, 2019, 11 pages.
Japanese Office Action regarding JP2016111630A dated Aug. 11, 2020, 4 pages.
Chinese Office Action regarding 201780034175.6 dated Aug. 12, 2020, 12 pages.

* cited by examiner

FIG. 4A
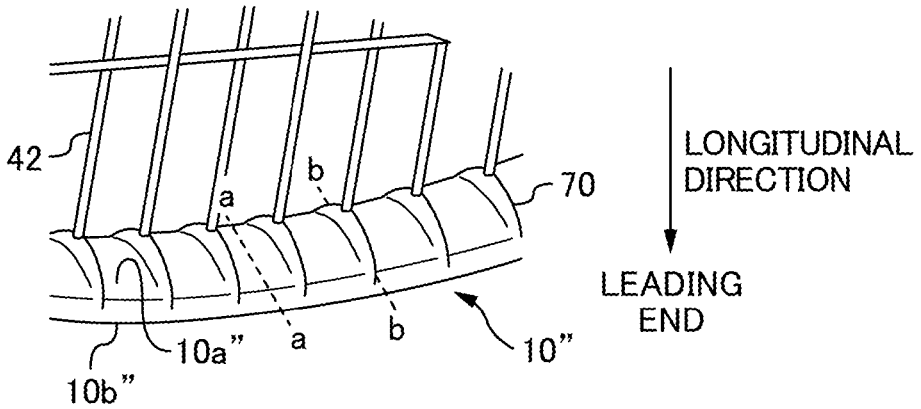
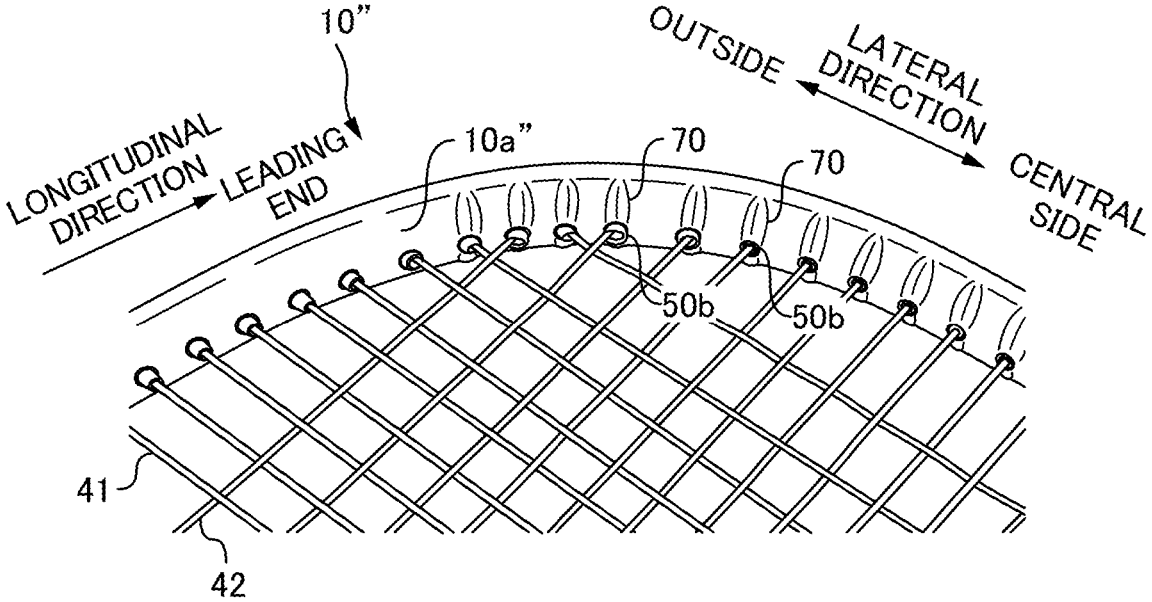
FIG. 4B
FIG. 4C
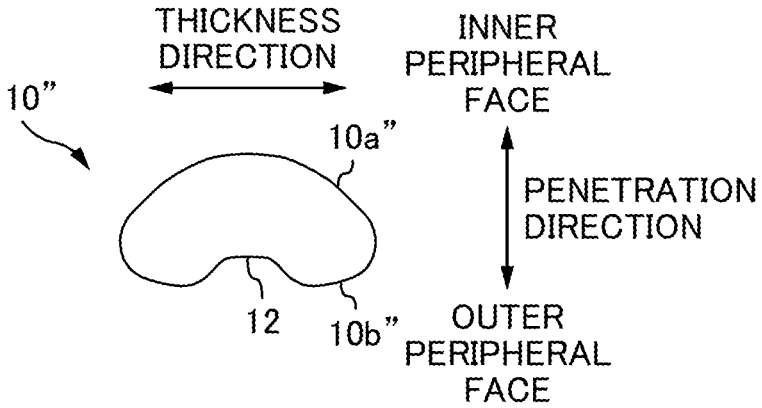

A-A

B-B

| ANGLE OF ATTACK θ [°] | 0 | 15 | 30 | 45 | 90 |
|---|---|---|---|---|---|
| RELATIVE TO COMPARATIVE EXAMPLE 2 [%] | −7.4 | −16.2 | −15.7 | −10.5 | −3.5 |

RACKET AND GROMMET

RELATED APPLICATIONS

This application is the U.S. National Phase under 35 U.S.C. § 371 of International Application No. PCT/JP2017/016711 A1, filed Apr. 27, 2017, which in turn claims the benefit of Japanese Application No. 2016-111630, filed Jun. 3, 2016, the contents of which are incorporated herein by reference in their entirety.

TECHNICAL FIELD

The present invention relates to a racket and a grommet.

BACKGROUND ART

Known rackets used for tennis and the like include a grip, an annular frame, and a shaft coupling the grip and the frame together. Grommets are also attached to an outer peripheral face of the frame (see, for example, Patent Literature 1). Generally, racket frames have a substantially elliptical shape elongated in the longitudinal direction as in Patent Literature 1, with a site of large curvature present at a leading end side of the frame (i.e. on the opposite side to the grip side). Curvature is the inverse of radius of curvature, with the greater the curvature (the smaller the radius of curvature) indicating more bending.

CITATION LIST

Patent Literature

Patent Literature 1: JP 2009-165703A

SUMMARY OF INVENTION

Technical Problem

When a frame (and in particular a leading end side thereof) includes a site with a large curvature, as in the racket described above, an airflow (flow of air) along an outer peripheral face thereof is prone to separating during a swing, which may induce greater air resistance. Furthermore, although there are particular demands to raise rigidity in the frame at this site, providing a member to raise rigidity thereat might lead to an increase in weight.

In consideration of the above issues, an objective of the invention is to achieve a reduction in air resistance acting on a racket during a swing and to also achieve improved rigidity while suppressing an increase in weight.

Solution to Problem

A main aspect for achieving the objective is a racket including: a grip; an annular frame; and a shaft coupling the grip and the frame together; wherein a projection is provided to an outer peripheral face on a leading end half of the frame in a predetermined range including a location of maximum curvature in a peripheral direction.

Other features of the invention will be made clear in the specification and drawings.

Advantageous Effects of Invention

The racket of the invention is able to achieve a reduction in air resistance acting on the racket during a swing and is also able to achieve improved rigidity while suppressing an increase in weight.

BRIEF DESCRIPTION OF DRAWINGS

FIG. 4A and FIG. 4B are perspective views of a frame of Comparative Example 2. FIG. 4C is a cross-section of a frame at position aa in FIG. 4A.

FIG. 11A is a cross-section illustrating the frame 10 alone, and FIG. 11B is a cross-section illustrating a state in which the grommet 50 has been attached to the frame 10.

DESCRIPTION OF EMBODIMENTS

Overview of Disclosure

Figure 1A:
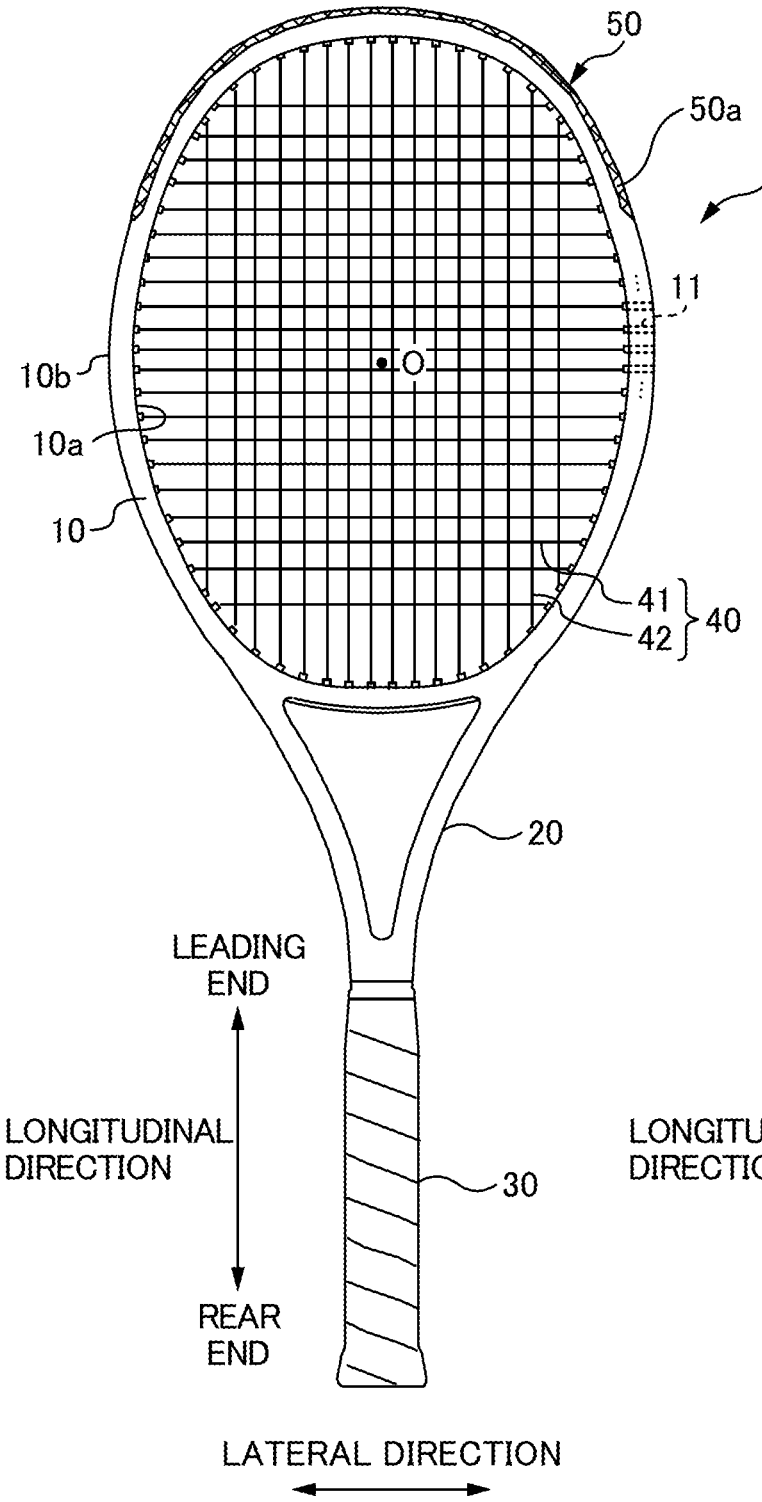
FIG. 1A is a front view of a racket.

At least the below matters will become clear from descriptions of this specification and drawings.

A racket will become clear including: a grip; an annular frame; and a shaft coupling the grip and the frame together; wherein a projection is provided to an outer peripheral face on a leading end half of the frame in a predetermined range including a location of maximum curvature in a peripheral direction.

Such a racket is able to achieve a reduction in air resistance acting on the racket during a swing and also to achieve improved rigidity while suppressing an increase in weight.

According to the racket, wherein preferably when the frame is viewed as a clock face with a leading end of the frame at 12 o'clock, the predetermined range is a range from 1 o'clock to 2 o'clock and a range from 10 o'clock to 11 o'clock.

Such a racket is able to raise rigidity at sites on the frame with a large curvature and is also able to achieve a reduction in air resistance.

According to the racket, wherein preferably the projection has a width in the peripheral direction wider at a position at a central side of the projection in a thickness direction, which is orthogonal to a hitting face formed inside the frame, than at a position at an end side of the projection in the thickness direction.

Such a racket is able to achieve a reduction in air resistance irrespective of the angle of the racket during a swing.

According to the racket, wherein preferably a height of the projection is 0.5 mm or lower.

Such a racket is able to suppress separation of airflow and is able to achieve a reduction in air resistance at the frame outer peripheral side.

According to the racket, wherein preferably: a grommet is attached to an outer periphery of the frame; and the grommet includes a recess configured to fit together with the projection of the frame on a back face of the grommet, which is a side of the grommet opposing the frame, and includes a protrusion formed to correspond to the recess on a front face of the grommet, which is the opposite side to the back face.

Such a racket is able to achieve a reduction in air resistance even when the grommet is attached to the frame.

Further, a grommet for attachment to an outer peripheral face of a frame of a racket that includes a grip, an annular frame, and a shaft coupling the grip and the frame together will become clear, the grommet including: a protrusion provided to a front face of the grommet at a site disposed in a predetermined range including a location of maximum curvature in a peripheral direction of the frame.

Such a grommet is able to achieve a reduction in air resistance easily.

According to the grommet, wherein preferably: a projection is provided on an outer peripheral face of the frame in the predetermined range; and the grommet includes a recess configured to fit together with the projection provided on a back face of the grommet.

Such a grommet is able to achieve a reduction in weight.

===Basic Racket Configuration===

A racket according to the invention will now be described for an embodiment in which a tennis racket is given as an example thereof.

Figure 1B:
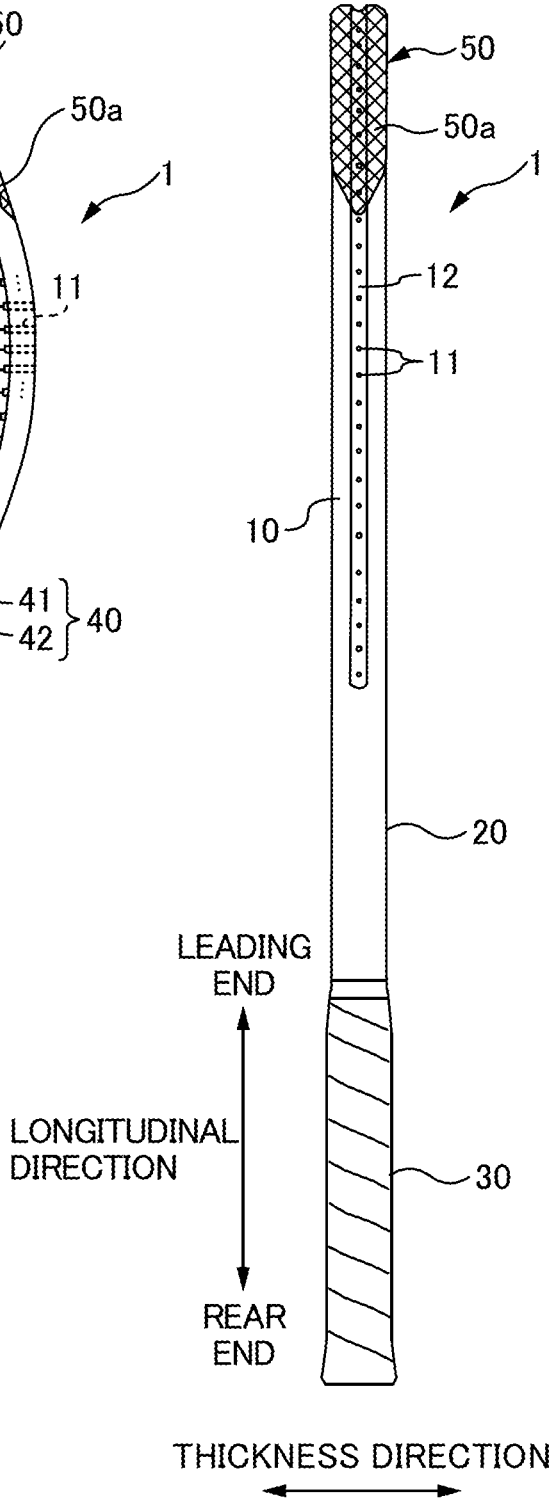
FIG. 1B is a side view of the racket.

FIG. 1A is a front view of a racket 1. FIG. 1B is a side view of the racket 1. The racket 1 includes a grip 30, an annular frame 10 (generally a substantially elliptical shaped frame elongated in the longitudinal direction), and a shaft 20 coupling the grip 30 and the frame 10 together. In the following explanation, a direction on the frame 10 in which the grip 30 and the shaft 20 are coupled together is referred to as the "longitudinal direction", a direction along a hitting face formed at the inside of the frame 10 and orthogonal to the longitudinal direction is referred to as the "lateral direction", and a direction orthogonal to both the longitudinal direction and the lateral direction (i.e. a direction orthogonal to the hitting face) is referred to as the "thickness direction". The side of the frame 10 where the shaft 20 is positioned is referred to as the "longitudinal direction rear end side", and the opposite side thereto is referred to as the "longitudinal direction leading end side".

Plural string holes 11 (through holes) for strings 40 to be passed through are formed in the frame 10 so as to penetrate from an inner peripheral face 10*a* to an outer peripheral face 10*b* of the frame 10. The string holes 11 are provided with an interval between the holes in a peripheral direction of the frame 10 so as to be arranged around substantially the entire periphery of the frame 10. A net-shaped hitting face is formed inside the frame 10. The hitting face is strung with plural strands of "lateral strings 41" which are sites where the strings 40 are strung along the lateral direction with an interval between the strings along the longitudinal direction, and with plural "longitudinal strings 42" which are sites where the strings 40 are strung along the longitudinal direction with an interval between the strings in the lateral direction.

As illustrated in FIG. 1B, a groove 12 is provided on the outer peripheral face 10*b* of the frame 10 at a central portion in the thickness direction. Openings of the string holes 11 are provided within the groove 12, with the strings 40 being folded back on themselves via the groove 12.

A grommet 50 is usually attached to the outer periphery of the frame 10 (at the outside of the outer peripheral face 10*b*). Such a grommet 50 includes tube-shaped (hollow circular column shaped) string protection members 50*b* (see FIG. 2C), and a belt-shaped base portion 50*a* (see FIG. 1) to couple the plural string protection members 50*b* together. The strings 40 are strung on the frame 10 in a state in which the grommet 50 has been attached to the frame 10.

===Frame of Comparative Example 1===

Figure 2A:
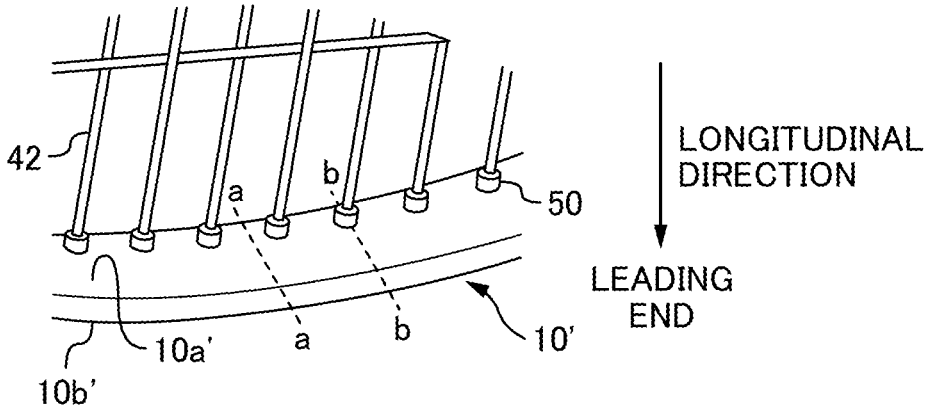
FIG. 2A is a perspective view of a frame of Comparative Example 1.
Figure 2B:
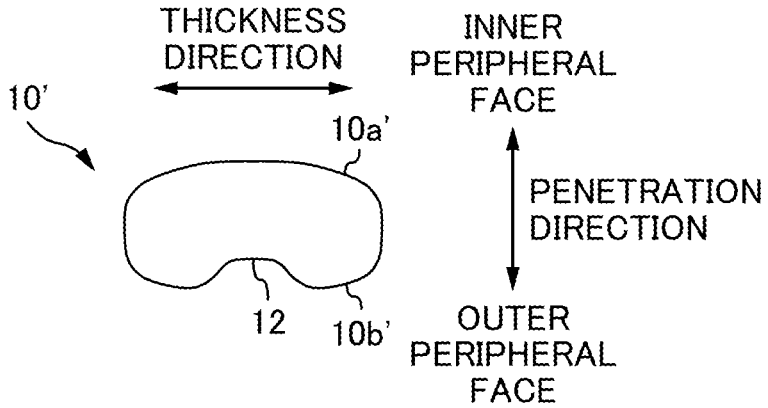
FIG. 2B and FIG. 2C are cross-sections of the frame of Comparative Example respectively taken at position aa and position bb in FIG. 2A.
Figure 2C:
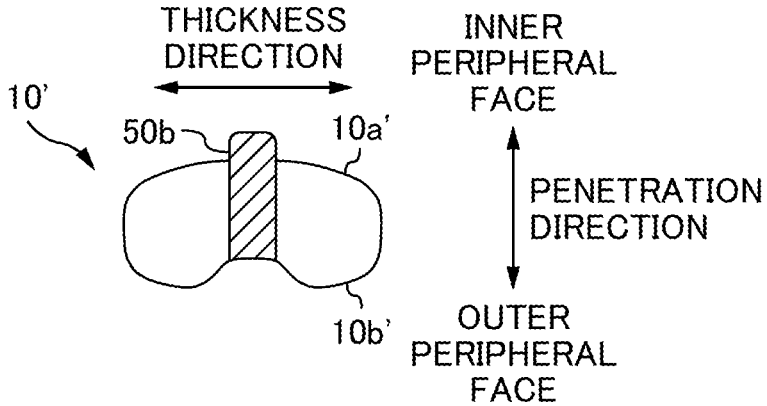
Figure 2D:
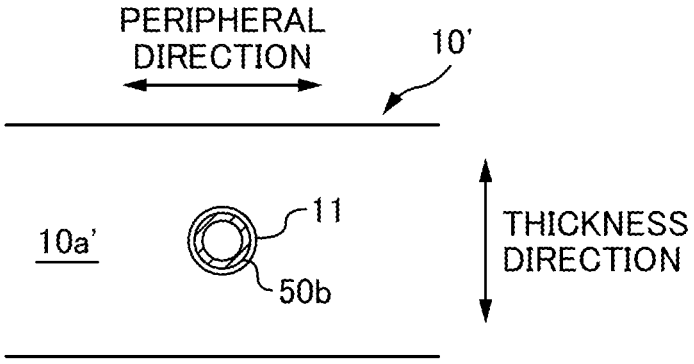
FIG. 2D is a diagram illustrating an inner peripheral face of the frame of Comparative Example 1, as viewed along a direction of penetration.

FIG. 2A is a perspective view of a frame 10' of Comparative Example 1 (of a leading end portion thereof). FIG. 2B and FIG. 2C are cross-sections respectively taken at the position aa and the position bb of FIG. 2A, so as to section the frame 10' of Comparative Example 1 along thickness and penetration directions. FIG. 2D is a view of an inner peripheral face 10*a'* of the frame 10' of Comparative Example 1, as viewed along the penetration direction. There is a direction normal to the outer peripheral face 10*b* at each of the positions where the string holes 11 are provided on the outer peripheral face 10*b* of the frame 10. In the present embodiment the string holes 11 each penetrate along the respective normal direction (a radial direction of the hitting face), and these normal directions are referred to as "penetration directions". In order to avoid complicating the drawings, the strings 40 etc. are omitted from some of the drawings, and hatching that should be appended to cross-sections therein is sometimes omitted.

As illustrated in FIG. 1, the strings 40 in the racket 1 are strung in a state in which the grommet 50 has been attached to the frame 10. Note that the grommet 50 is attached to the frame 10 by fitting the base portion 50*a* into the groove 12 of the frame 10 while passing the string protection members 50*b* through the string holes 11 from the outer peripheral face 10*b* side of the frame 10 (see FIG. 2C, FIG. 2D). The strings 40 are accordingly passed through the string holes 11 by being passed through the base portion 50*a* of the grommet and through the respective holes of the string protection members 50*b*.

Figure 3A:
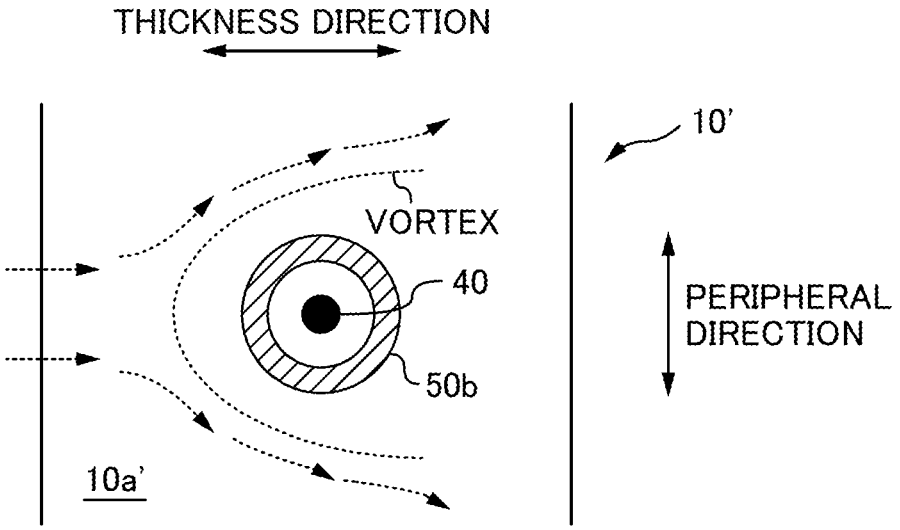
FIG. 3A and FIG. 3B are diagrams to explain an airflow passing over the frame of Comparative Example 1.
Figure 3B:
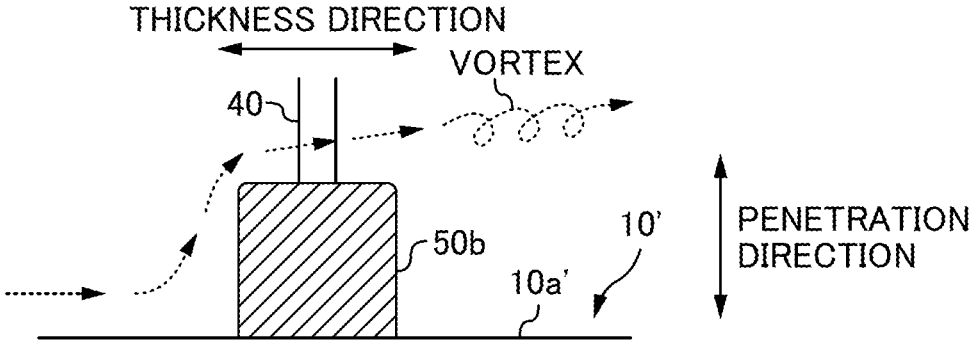

FIG. 3A and FIG. 3B are diagrams to explain an airflow passing over an inner peripheral face 10*a'* of the frame 10' of Comparative Example 1. FIG. 3A is a diagram illustrating the vicinity of a string protection member 50*b*, as viewed along the penetration direction. FIG. 3B is a diagram illustrating the vicinity of the string protection member 50*b*, as viewed along a peripheral direction of the frame 10'. As illustrated in FIG. 2A and FIG. 2C, in the frame 10' of Comparative Example 1, a leading end portion of each of the string protection members 50*b* projects out from the inner peripheral face 10*a'* of the frame 10'. Accordingly, as illustrated in FIG. 3A and FIG. 3B, during a swing of the racket the airflow (indicated by the dotted arrows) passing over the inner peripheral face 10*a'* of the frame 10' flows around the string protection members 50*b*, namely flows around circular columns.

Generally, when a circular column is placed in a flow, the flow separates from the surface of the circular column so as to generate a necklace-shaped vortex at the upstream side of the side faces of the circular column (of the string protection member 50*b*), as illustrated in FIG. 3A. Vortexes are also generated at the downstream side of the circular column (of the string protection member 50*b*), as illustrated in FIG. 3B. This is known to result in a loss of pressure occurring at the downstream side of the circular column, and in an increase in drag.

The air resistance acting on the racket accordingly increases in cases such as the frame 10' of Comparative Example 1 in which the tube-shaped string protection members 50*b* project from the inner peripheral face 10*a'* of the frame 10', and the airflow flows around the string protection members 50*b* during a swing.

===Frame of Comparative Example 2===

Figure 5A:
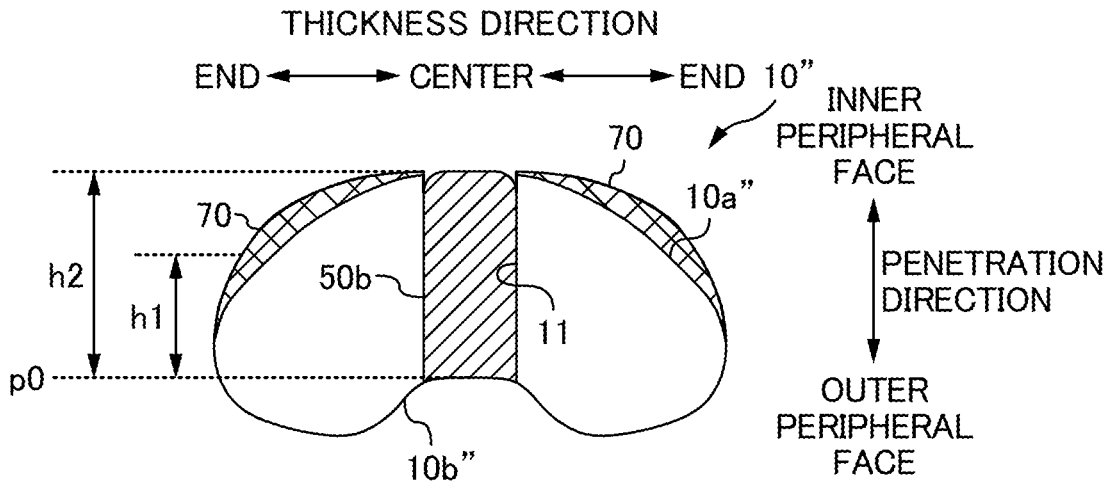
FIG. 5A is a cross-section of the frame at position bb in FIG. 4A.
Figure 5B:
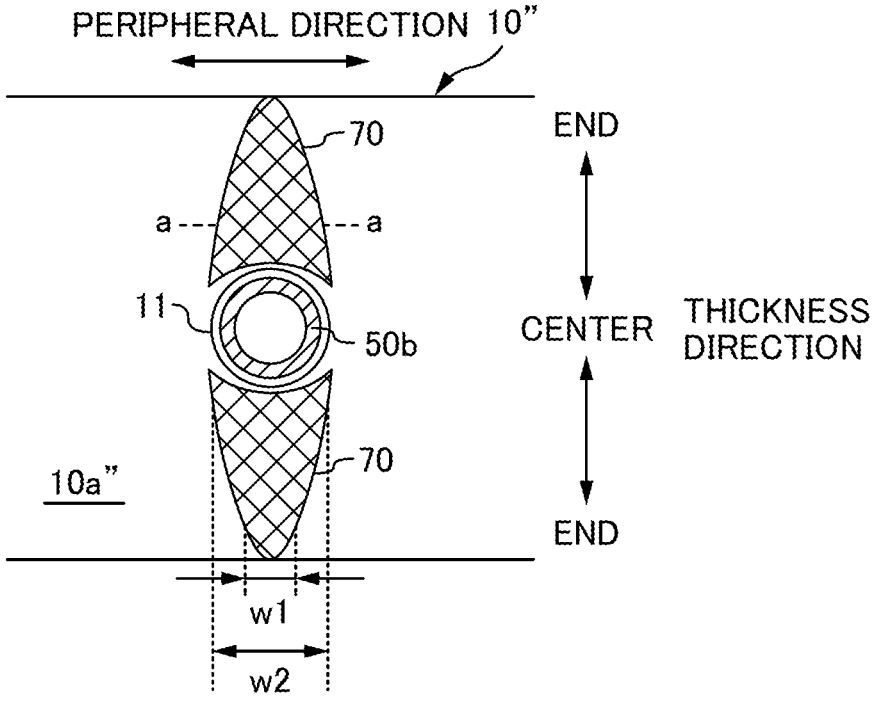
FIG. 5B is diagram illustrating an inner peripheral face of the frame as viewed along a penetration direction.
Figure 5C:
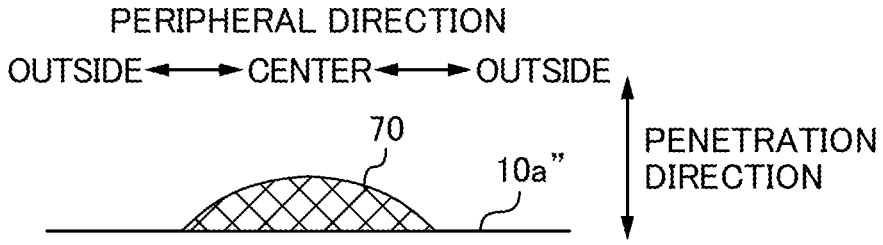
FIG. 5C is a cross-section of the frame at position aa in FIG. 5B.
Figure 6A:
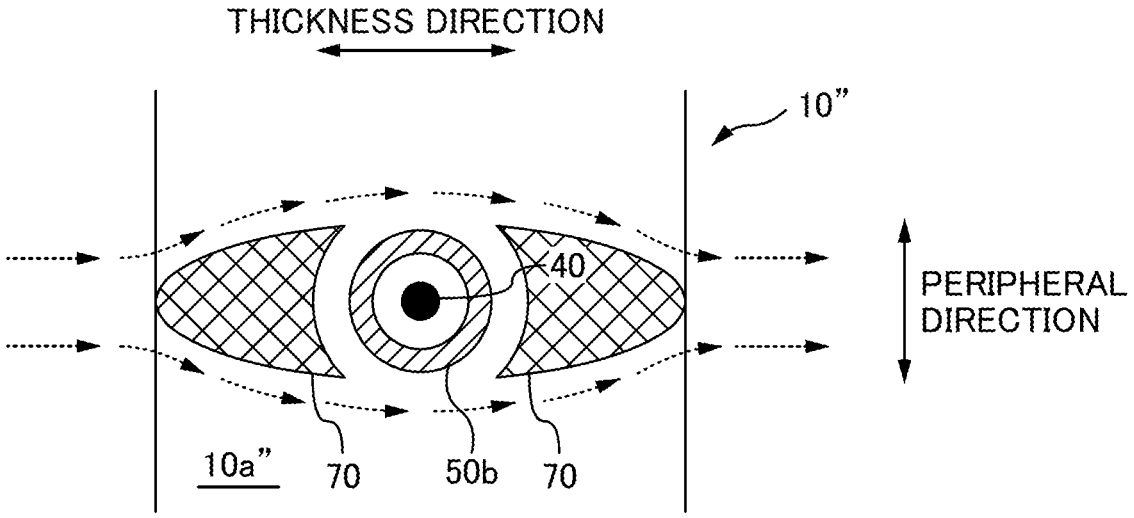
FIG. 6A and FIG. 6B are diagrams to explain an airflow passing over the frame of Comparative Example 2.
Figure 6B:
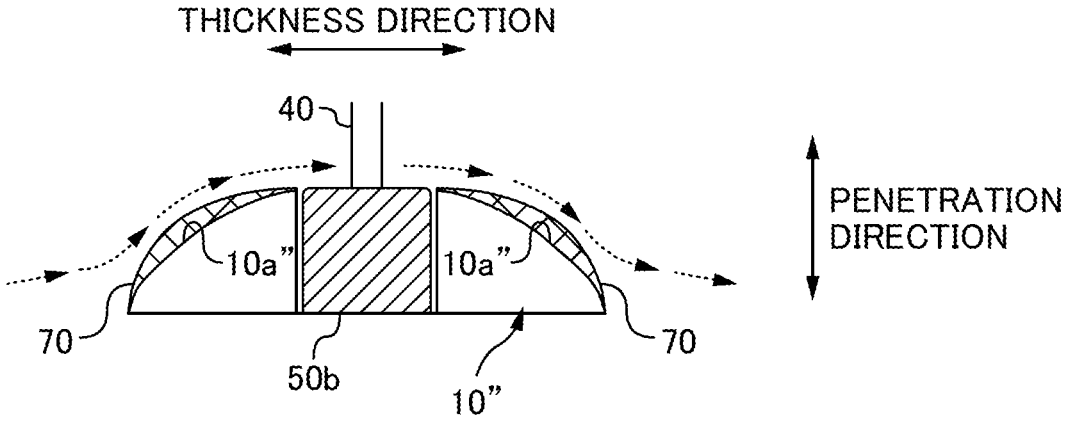

FIG. 4A and FIG. 4B are perspective views of a frame 10" of Comparative Example 2 (of a leading end portion thereof). FIG. 4C is a cross-section at position aa in FIG. 4A, illustrating the frame 10" sectioned along the thickness and penetration directions. FIG. 5A is a cross-section at position bb in FIG. 4A, illustrating the frame 10" sectioned along the thickness and penetration directions. FIG. 5B is a diagram illustrating an inner peripheral face 10*a"* of the frame 10", as viewed along the penetration direction. FIG. 5C is a cross-section at position aa in FIG. 5B, illustrating the frame 10" sectioned along a peripheral direction and penetration direction of the frame 10". FIG. 6A and FIG. 6B are diagrams to explain an airflow passing over the inner peripheral face 10*a"* of the frame 10".

Pairs of projections 70 are provided on the inner peripheral face 10*a"* of the frame 10" of Comparative Example 2 at positions in the peripheral direction of the frame 10" overlapping the positions where the string holes 11 are provided (for example, at the position bb in FIG. 4A). The pairs of projections 70 are arranged in a row along the thickness direction, as illustrated in FIG. 5B.

The shape of the projections 70 as viewed along the penetration direction (FIG. 5B) is a shape resembling an ellipse cut in half along the minor axis direction, with the shape arranged such that the major axes of the ellipse is along the thickness direction. Namely, the shape of the projections 70 as viewed along the penetration direction is a shape of an ellipse in which the major axis direction is arranged so as run along the direction of airflow during a swing. This thereby results in an aerodynamic shape at both side faces of each of the projections 70 in the peripheral direction.

More specifically, when each projection 70 is viewed along the penetration direction (FIG. 5B), a peripheral direction width W2 at a position on the central side of the projection 70 in the thickness direction is wider than a peripheral direction width W1 at a position on the end side thereof in the thickness direction (W1<W2). Moreover, the peripheral direction width of each of the projections 70 widens gradually on progression in the thickness direction from the thickness direction end side toward the thickness direction central side, as viewed along the penetration direction (FIG. 5B). A center of the corresponding string hole 11 in the peripheral direction is aligned with a center of each of the respective projections 70 in the peripheral direction. The maximum width of each projection 70 in the peripheral direction is the diameter of the string hole 11 or greater. The string protection members 50*b* accordingly do not project further out in the peripheral direction than the projections 70.

Accordingly, as illustrated in FIG. 6A, an airflow passing over the inner peripheral face 10*a"* of the frame 10" along the thickness direction during a swing does not separate from the projections 70 at the two peripheral direction side faces thereof, and instead flows along the two side faces of the projections 70. This enables the generation of vortexes to be suppressed. Namely, disturbance to the airflow flowing along portions at the two sides of the strings 40 and the string protection members 50*b* can be suppressed, enabling the air resistance acting on the frame 10" during a swing to be reduced. Moreover, providing the projections 70 causes airflow to flow along the two side faces of the projections 70, and enables a reduction to be achieved in the airflow that hits the strings 40 and the string protection members 50*b*. This may also be said to enable a reduction to be achieved in the air resistance acting on the frame 10". The swing speed can be improved as a result, enabling ball speed to be increased and ball spin amount to be increased.

As described above, FIG. 5A is a cross-section of the frame 10" at the position bb in FIG. 4A, namely a cross-section of the frame 10" at a central portion of one of the projections 70 in the peripheral direction. The peripheral direction central portion of an upper face of the projection 70 (a face on the inner peripheral face side in the penetration direction) has, in particular, an aerodynamic shape such as that illustrated in FIG. 5A.

More specifically, as illustrated in FIG. 5A, a reference position p0 is the position in the penetration direction of a string hole 11 (opening) provided in the outer peripheral face 10*b"* of the frame 10", namely the position in the penetration direction of a bottom portion of the groove 12. A height h2 in the penetration direction from the reference position p0 to a projection 70 at the thickness direction central side position of the projection 70 at a site on the frame 10" where the projection 70 is provided (in particular, where the peripheral direction central portion of the projection 70 is provided) is greater than a height h1 in the penetration direction from the reference position p0 to the projection 70 at a position of the thickness direction end side of the projection 70 (h1<h2). Further stated, at the site on the frame 10" where the projection 70 is provided (in particular, where the central portion of the projection 70 in the peripheral direction is provided) the height in the penetration direction from the reference position to the projection 70 gradually increases on progression from the thickness direction end side toward the thickness direction central side of the projection 70.

Accordingly, as illustrated in FIG. 6B, the airflow passing along the thickness direction over the inner peripheral face 10*a"* of the frame 10" during a swing flows along the upper faces of the projections 70 without separating from the upper faces of the projections 70, enabling vortexes to be suppressed from being generated. Namely, disturbance of the airflow flowing over upper portions of the string protection members 50*b* can be suppressed, enabling a reduction to be achieved in the air resistance acting on the frame 10" during a swing. Swing speed can accordingly be improved as a result.

Note that, as illustrated in FIG. 5C, the projections 70 gradually increase in height in the penetration direction on progression from the outer sides toward the central side in the peripheral direction.

As illustrated in FIG. 4A and FIG. 4B, the projections 70 are provided at positions that overlap with the string holes 11 in the peripheral direction of the frame 10". Accordingly, as described above, airflow flowing along the two side faces of the projections 70 (FIG. 6A) enables a reduction to be achieved in the airflow that hits the strings 40 and the string protection members 50*b*, enabling the air resistance to be reduced. The projections 70 are, however, not provided at positions that do not overlap with the string holes 11 (for example, at the position aa in FIG. 4A). However, this may be reported as not being an issue since airflow is not disturbed thereat by the strings 40 and the string protection members 50*b*.

Namely, providing the projections 70 only at positions in the peripheral direction of the frame 10" that overlap with the string holes 11 reduces the number of the projections 70 while also reducing the air resistance acting on the frame 10" during a swing. This enables, for example, easy manufacture of the frame 10". However, the placement of the projections 70 is not limited to the placement described above, and projections 70 may also be provided at positions not overlapping with the string holes 11 in the peripheral direction.

As illustrated in FIG. 5B, the projections 70 are provided on the inner peripheral face 10*a*" of the frame 10" at both thickness direction sides of the thickness direction center of the inner peripheral face 10*a*". Namely, the projections 70 are provided in pairs. This thereby enables air resistance to be reduced and swing speed to be improved whichever of the thickness direction hitting faces of the racket 1 is facing in a ball-hitting direction when swinging.

In particular, each of the pairs of projections 70 is configured so as to have a symmetrical shape with respect to the thickness direction center of the inner peripheral face 10*a*" of the frame 10", enabling the same performance to be achieved on both the front and back of the racket 1 in the thickness direction. This thereby enables the racket 1 to be used without paying attention to which is the front and which is the back of the racket 1.

A swing is a motion in a circular arc, and so the leading end portion of the frame 10" in the longitudinal direction has a faster speed and is subject to greater air resistance when swinging than a rear end portion of the frame 10" in the longitudinal direction. The air resistance acting on the leading end portion of the frame 10" accordingly has a large effect on swing speed. As illustrated in FIG. 4A and FIG. 4B, providing the plural projections 70 at only the leading end portion of the frame 10" enables the air resistance acting on the leading end portion of the frame 10" to be reduced, so as to efficiently improve the swing speed. The placement of the projections 70, however, is not limited to the placement described above, and the projections 70 may also be provided to portions of the frame 10" other than at the leading end portion.

From out of the string holes 11 provided in the leading end portion of the frame 10", the angles formed between the penetration direction and the longitudinal direction are smaller for the string holes 11 disposed at a lateral direction central side. Even in the case where the string protection members 50*b* do not project from the string holes 11, the strings 40 disposed thereat are accordingly not prone to contacting the frame 10" (the edges of the string holes 11), and the strings 40 and the frame 10" are not prone to damage. The angles formed between the penetration direction and the longitudinal direction or the lateral direction, however, are larger at the string holes 11 at the outside in the lateral direction. The strings 40 thereat accordingly bend at the inner peripheral face 10*a*" of the frame 10". The strings 40 thereat would accordingly make direct contact with the frame 10", causing damage to the strings 40 and the frame 10", in the case where the string protection members 50*b* do not project from the string holes 11.

Thus, as illustrated in FIG. 4B, the string protection members 50*b* project further than the projections 70 at the string holes 11 disposed at the lateral direction outsides, and the string protection member 50*b* do not project further than the projections 70 at the string holes 11 disposed at the lateral direction central side. Namely, the length of projection of the string protection members 50*b* from the projections 70, for each of the string protection members 50*b* that have passed through the string holes 11 overlapping in the peripheral direction with each of the projections 70, is shorter for the projections 70 disposed more towards the lateral direction central side from out of the projections 70 provided at the leading end portion of the frame 10", than for the projections 70 disposed at the lateral direction outsides thereof. Note that as illustrated in FIG. 5A, at the positions of the string holes 11 disposed at the lateral direction central side, the upper faces of the projections 70 (the thickness direction central portions of the upper faces thereof) are in the same plane as upper faces of the corresponding string protection members 50*b*.

Adopting such a configuration means that airflow does not hit string protection members 50*b* projecting from the projections 70 at the string holes 11 disposed at the lateral direction central side, enabling disturbance to the airflow to be suppressed. This thereby enables a further reduction to be achieved in the air resistance acting at a lateral direction central portion of the leading end portion of the frame 10", enabling swing speed to be improved. At the string holes 11 on the lateral direction outsides, however, damage to the strings 40 and the frame 10" can be prevented due to the string protection members 50*b* projecting from the projections 70.

In this example, the projections 70 are divided at the thickness direction center of the frame 10", and there are no projections 70 present at the thickness direction central portion. There is no limitation thereto, however. For example, the projections 70 provided at the two thickness direction sides of the thickness direction center of the frame 10 may be integrated together.

The projections 70 are provided in the above manner to the inner peripheral face 10*a*" in the frame 10" of the Comparative Example 2. This enables air resistance during a swing to be reduced more than in the frame 10' of Comparative Example 1. However, in the present embodiment, a further reduction in air resistance is achieved by focusing on the flow of air at the outer periphery of the frame during serves, strokes and the like.

Present Embodiment

Figure 7A:
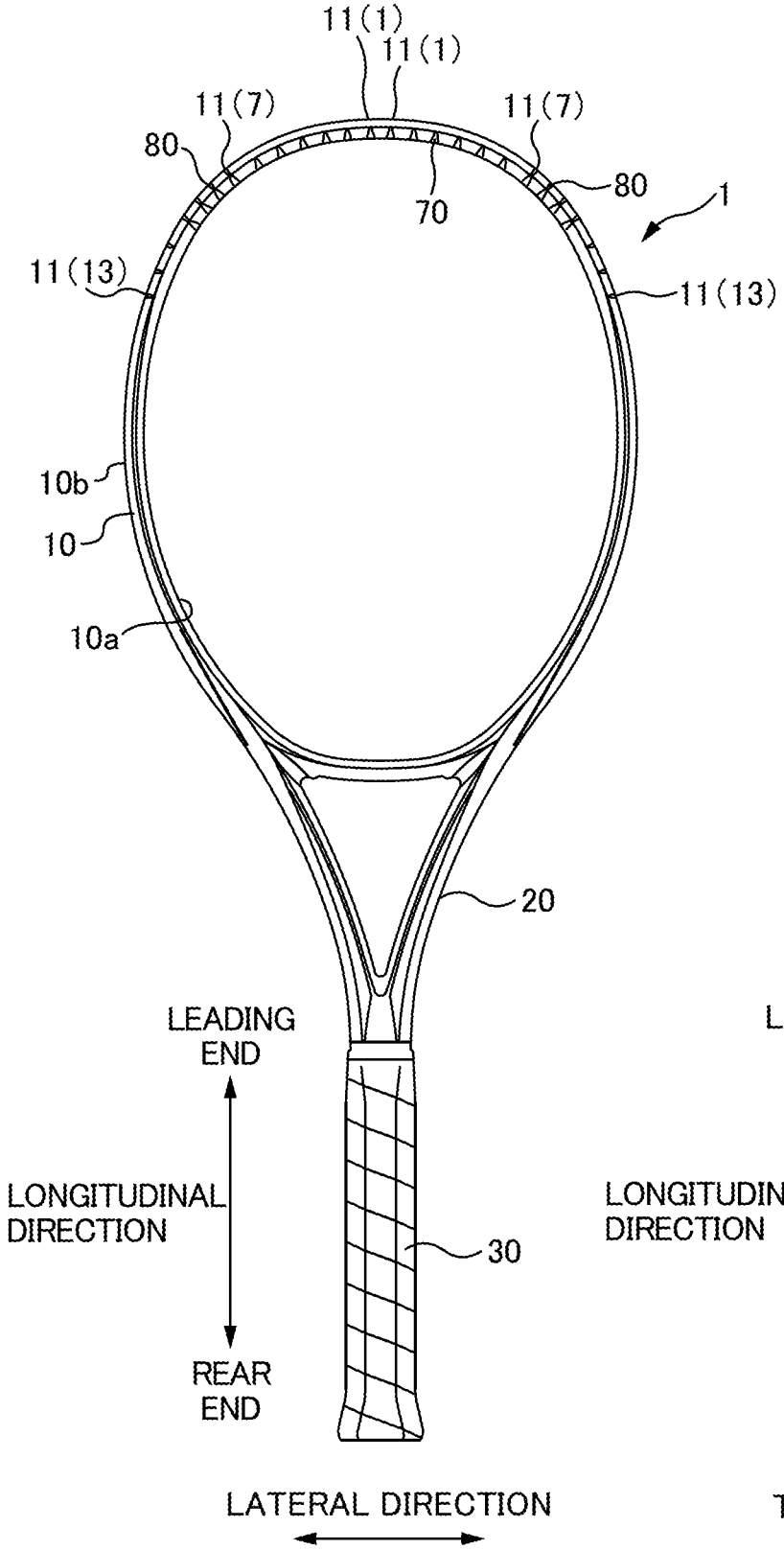
FIG. 7A is a front view of a racket 1 of an embodiment.
Figure 7B:
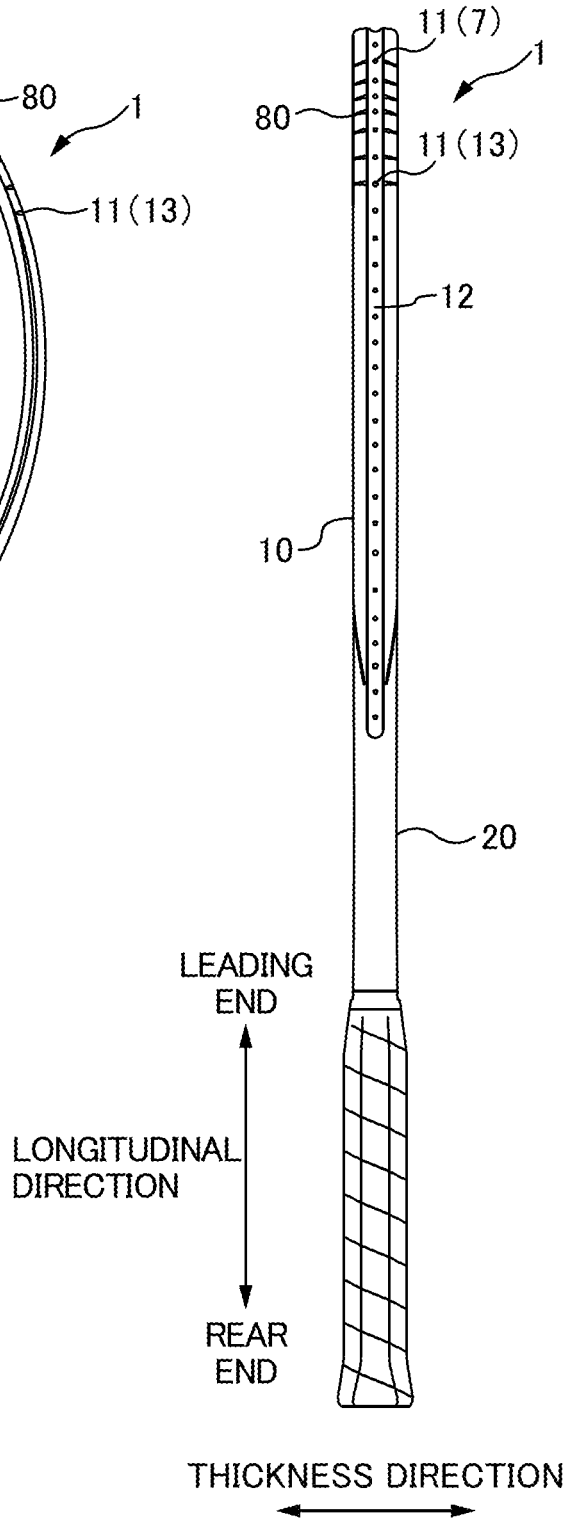
FIG. 7B is a side view of the racket 1 of the present embodiment.

FIG. 7A is a front view of a racket 1 of the present embodiment, and FIG. 7B is a side view of the racket 1 of the present embodiment. A grommet 50 and strings 40 are omitted from illustration in FIG. 7A. In FIG. 7A and FIG. 7B, the positions of the string holes 11 as counted from a top position (leading end) of the frame 10 are given in parenthesis. For example, the string hole 11 (7) is at a location where the seventh string hole 11 is provided, as counted from the top position of the frame.

<Frame>

In the present embodiment, projections 70 are provided on the inner peripheral face 10*a* of the frame 10 of the racket 1, similarly to in Comparative Example 2. In the present embodiment, however, projections (projections 80) are provided to the frame 10 not only on the inner peripheral face 10*a* thereof, but also to the outer peripheral face 10*b* thereof.

The projections 80 are provided on the outer peripheral face 10*b* at the leading end half of the frame 10 in a predetermined range including a position where there is maximum curvature in the peripheral direction. Specifically, when the inside (hitting face) of the frame 10 is viewed as a clock face with the top position (leading end) of the frame 10 at 12 o'clock, the projections 80 are provided in a range from 1 o'clock to 2 o'clock, and in a range from 10 o'clock to 11 o'clock. More specifically, the projections 80 are provided so as to correspond to the respective string holes 11 in the ranges from the string holes 11 (7) to the string holes 11 (13) on the left and right. The projections 70 on the inner peripheral face 10*a* side are moreover provided so as to correspond to the string holes 11 in ranges from the top position to the string holes 11 (10) (the ranges where the string protection members 50*b* of the grommet 50 are formed). Note that although in the present embodiment the projections 80 are provided so as to correspond to the string holes 11, there is no limitation thereto. The projections 80 may also be provided so as not to correspond to the string holes 11, as long as at least one of the projections 80 is formed in the range described above. Because providing the projections 80 enables the rigidity of the frame 10 to be raised, however, providing the projections 80 so as to correspond to the string holes 11 as in the present embodiment enables the load on the frame 10 to be reduced when the strings 40 are strung (see FIG. 1).

As illustrated in FIG. 7B, the projections 80 are provided on both thickness direction sides of the thickness direction center of the outer peripheral face 10*b*. Namely, the projections 80 are provided on the outer peripheral face 10*b* of the frame 10 so as to configure pairs on either side of the respective string holes 11. This thereby enables air resistance to be reduced, thus enabling the swing speed to be improved whichever of the thickness direction hitting faces of the racket 1 is facing in the ball-hitting direction when swinging.

In particular, each of the pairs of projections 80 is configured so as to have a symmetrical shape with respect to the thickness direction center of the outer peripheral face 10*b* of the frame 10, enabling the same performance to be achieved on both the front and back of the racket 1 in the thickness direction. This thereby enables the racket 1 to be used without paying attention to which is the front and which is the back of the racket 1.

The shapes of the projections 80 are substantially the same as the shapes of the projections 70. Namely, both side faces of each projection 80 in the peripheral direction have an aerodynamic shape, with the peripheral direction width of each projection 80 gradually widening on progression in the thickness direction from the end side toward the central side, as viewed along the penetration direction. Namely, the width thereof in the peripheral direction is wider at central side position in the thickness direction than at an end side position in the thickness direction. This thereby enables a reduction to be achieved in air resistance irrespective of the angle of the racket 1 during a swing.

Note that in the present embodiment, a mold (not illustrated in the drawings) for the racket 1 is formed with a pattern corresponding to the projections 80, and the projections 80 are formed on the frame 10 by molding the racket 1 using the mold. The thickness of the frame 10 in the penetration direction (wall thickness) is thus substantially the same at sites where the projections 80 are formed and at sites where the projections 80 are not formed. Namely, the wall thickness of the frame 10 is uniform regardless of location. Providing the projections 80 in this manner rather than attaching a separate member makes manufacturing easy, and moreover enables the rigidity of the frame 10 to be raised while suppressing an increase in weight.

<Projections at the Outer Peripheral Side>

Providing projections induces flow in a boundary layer to transition from a laminar flow to a turbulent flow, and suppresses separation thereof. This enables the air resistance to be reduced due to preventing the generation of large vortexes (a tripping wire effect). The height of the projections 80 is accordingly preferably set at the same height as the boundary layer in a laminar flow boundary layer, or slightly lower than the height of the boundary layer.

Generally, when a viscous substance is flowing at some speed, a distinction may be made between a portion thereof where the viscosity may be ignored (a portion distanced from the racket 1 in this case), and a portion thereof that is affected by viscosity (a portion near to the racket 1 in this case). The boundary layer is the portion affected by viscosity. Taking δ to indicate the height of the boundary layer, then δ is expressed by the following Equation 1 for a boundary layer in laminar flow.

$$\delta = 5.0 \times (\text{kinematic viscosity} \times \text{distance from object edge/speed})^{1/2} \qquad \text{Equation 1}$$

Namely, the height of the boundary layer is dependent on the square root of the distance from the object edge.

Wherein kinematic viscosity of air: 15 $mm^2/s$ at 20° C.

swing velocity: 30 m/s (108 km/h)

distance from object edge (20 mm)

Substituting the above values in Equation 1 gives δ=0.5 mm. The swing velocity is the swing speed for an upper-intermediate level tennis player. The distance from the object edge is the frame thickness (length from the thickness direction edge) for face-on direction, and is the distance between projections for peripheral length direction. Accordingly, setting the height of the projections 80 to 0.5 mm or lower enables the flow in the boundary layer to be made turbulent and airflow separation to be suppressed, as described later (see FIG. 12B), thereby enabling air resistance to be reduced. Conversely, were the height of the projections 80 to be set greater than the boundary layer δ then this might disturb flow including flow outside the boundary layer, resulting in the formation of large vortexes and an increase in resistance.

Note that this calculation for a professional level swing speed of 40 m/s yields δ=0.43 mm. Based on these calculations, the height of the projections 80 is set in the present embodiment to approximately 0.4 mm, this being slightly below δ.

An appropriate projection width is from approximately 3 mm to approximately 8 mm, and is preferably 5 mm, in order to achieve a combination of a degree of smoothness that avoids the projections breaking and damage to other objects as a result of contact with the racket, while also maintaining the effectiveness of the projections to disturb flow so as to induce a tripping wire effect.

<Grommet>

Figure 8:
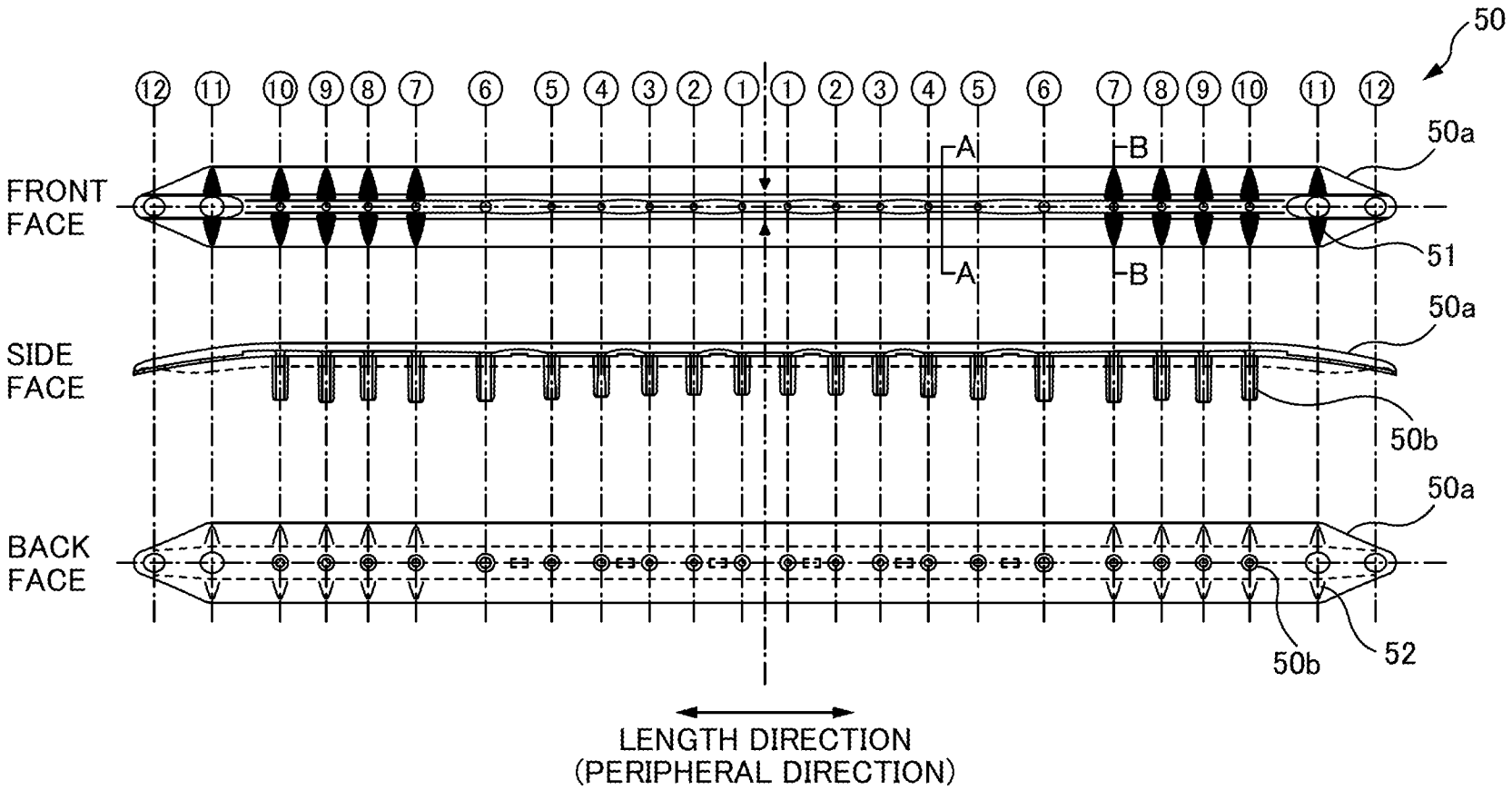
FIG. 8 is an explanatory diagram of a grommet 50 of the present embodiment.
Figure 9:
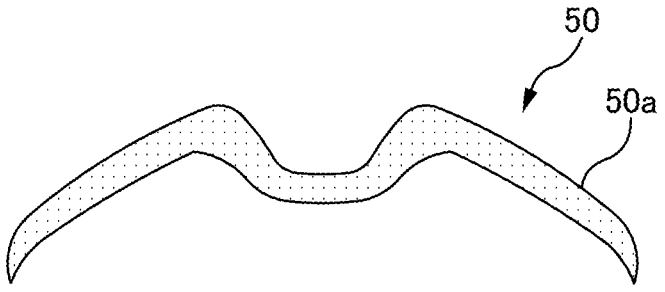
FIG. 9 is a diagram illustrating a cross-section taken along A-A in FIG. 8 and a cross-section taken along B-B in FIG. 8.
Figure 9:
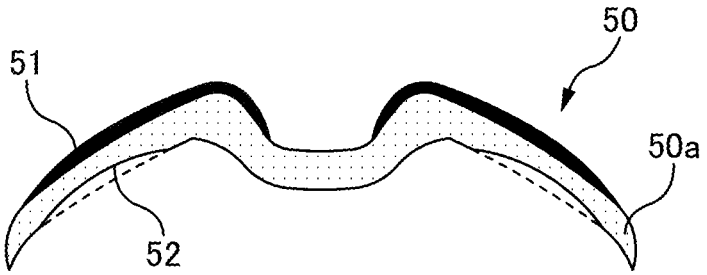

FIG. 8 is a diagram to explain a grommet 50 of the present embodiment. FIG. 9 is a diagram including a cross-section taken along A-A and a cross-section taken along B-B in FIG. 8. The circled numbers in FIG. 8 correspond to the numbers of the string holes 11 in the frame 10 (the numbers in parenthesis in FIG. 7) when the grommet 50 has been placed on the frame 10. Namely, the length direction (i.e. peripheral direction) center of the grommet 50 is disposed at the top position (the leading end) of the frame 10, and the two string protection members 50*b* closest to the center are inserted through the string holes 11 (1).

Figure 10A:
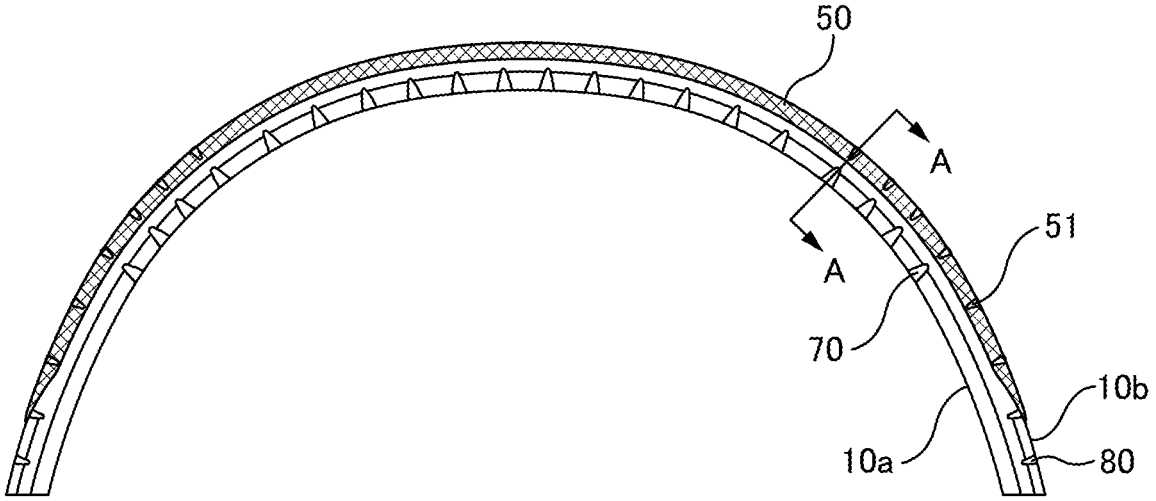
FIG. 10A is a front view of a leading end portion of the racket 1 of the present embodiment in a state in which the grommet 50 has been attached to a frame 10 of the racket 1.
Figure 10B:
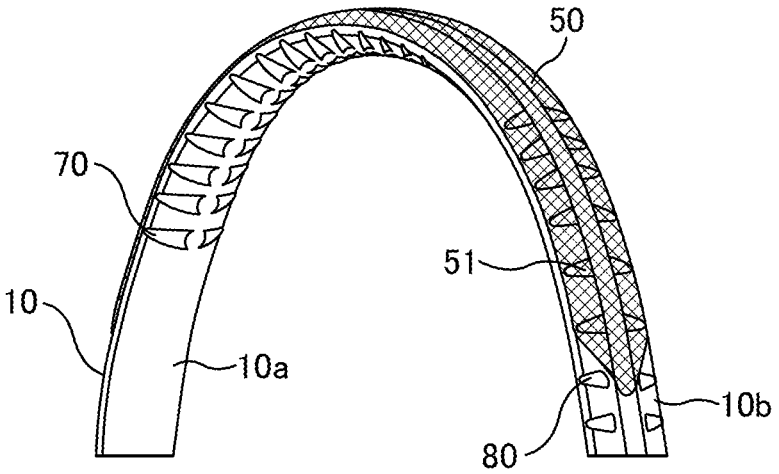
FIG. 10B is a perspective view thereof.
Figure 11A:
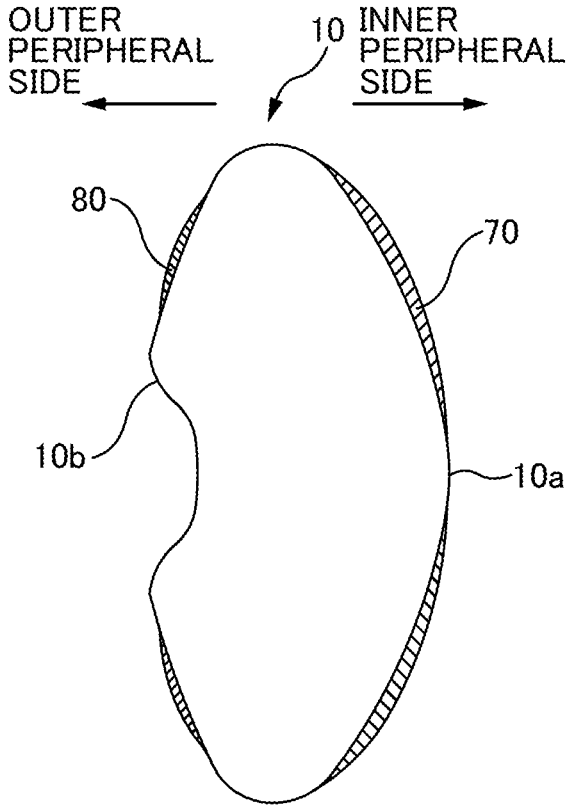
FIG. 11A and FIG. 11B are cross-sections taken along A-A in FIG. 10A.
Figure 11B:
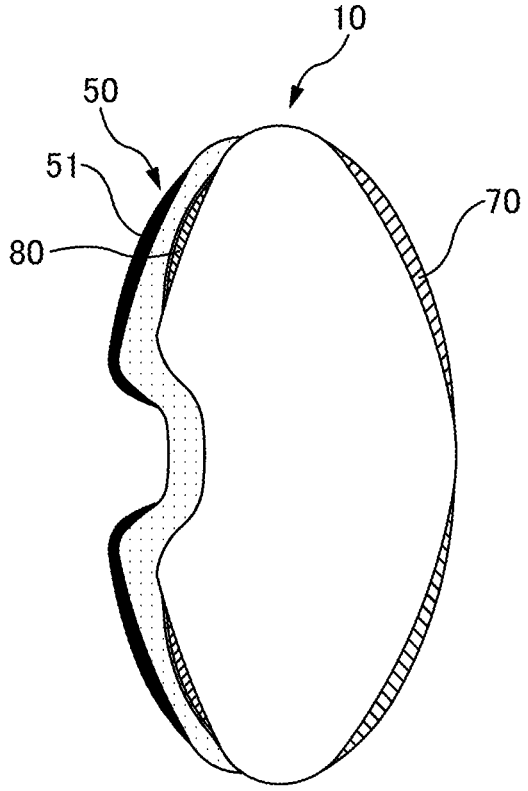

FIG. 10A is a front view of a leading end portion of the racket 1 of the present embodiment in a state in which the grommet 50 has been attached to the frame 10 of the racket 1. FIG. 10B is a perspective view thereof. FIG. 11A and FIG. 11B are cross-sections taken along A-A in FIG. 10A. FIG. 11A is a cross-section illustrating the frame 10 alone, and FIG. 11B is a cross-section illustrating a state in which the grommet 50 has been attached to the frame 10.

As described above, the grommet 50 includes the tube-shaped (hollow circular column shaped) string protection members 50*b* and the belt-shaped base portion 50*a* to couple the plural string protection members 50*b* together. The base portion 50*a* of the grommet 50 in the present embodiment also includes protrusions 51 and recesses 52.

The recesses 52 are provided on a back face (inside face) of the base portion 50*a*, this being a face on the side opposing the frame 10. The recesses 52 are provided with indented shapes so as to fit together with the projections 80 on the outer periphery of the frame 10 when the grommet 50 has been attached to the frame 10.

The protrusions 51 are provided on a front face (outside face) of the base portion 50*a*, this being a face on the opposite side to the back face. The positions where the protrusions 51 are formed correspond to the positions where the recesses 52 (and the projections 80 of the frame 10) are formed. The shape of the protrusions 51 is a similar shape to that of the projections 80 of the frame 10 (i.e. an aerodynamic shape). This enables a reduction in air resistance similar to that of the frame 10 alone to be achieved when the grommet 50 has been attached to the frame 10.

Note that the recesses 52 and the protrusions 51 of the grommet 50 in the present embodiment are provided at positions corresponding to the respective string holes 11 of the frame 10 from the string holes 11 (7) to the string holes 11 (11), as illustrated in FIG. 8. Thus when the grommet 50 has been attached to the frame 10, the projections 80 at positions up to the string holes 11 (11) of the frame 10 are covered by the grommet 50. Conversely, the projections 80 at positions of the string holes 11 (12) and the string holes 11 (13) are not covered by the grommet 50, and are therefore exposed (see FIG. 10A, FIG. 10B).

In this manner, there are in the present embodiment both sites where the projections 80 of the frame 10 are exposed and sites where the projections 80 are not exposed when the grommet 50 has been attached to the frame 10. There is no limitation thereto, however, and, for example, a configuration may be adopted in which none of the projections 80 of the frame 10 are exposed (i.e. all are covered by the grommet 50). In cases in which the projections 80 are not exposed, a configuration may be adopted in which the projections 80 are not provided to the frame 10 and there are only protrusions 51 provided to the grommet 50. For example, the grommet 50 of the present embodiment may be attached to the racket 1 of Comparative Example 1 or Comparative Example 2. In such cases there may be recesses 52 present at positions corresponding to the protrusions 51, or the recesses 52 may be omitted. Providing the recesses 52 enables a reduction in weight to be achieved.

<Flow of Air at Frame Outside>

Figure 12A:
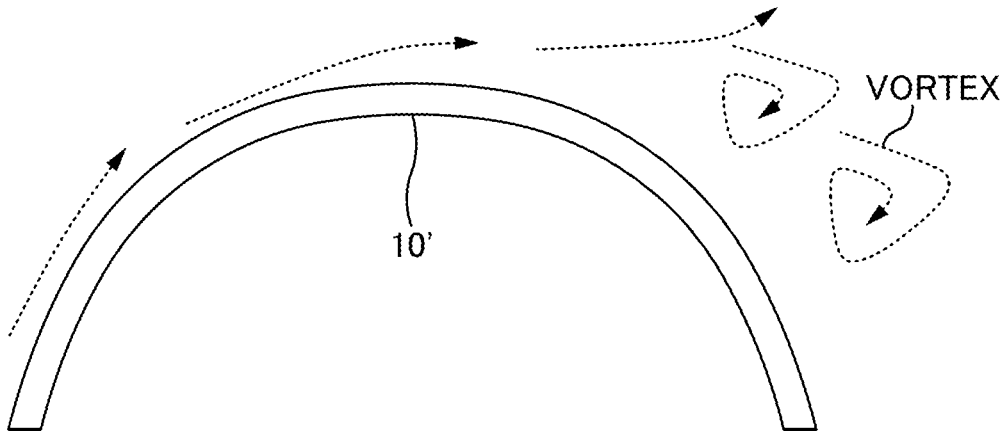
FIG. 12A is a concept diagram illustrating a flow of air at the outside of a frame 10' of Comparative Example 1.
Figure 12B:
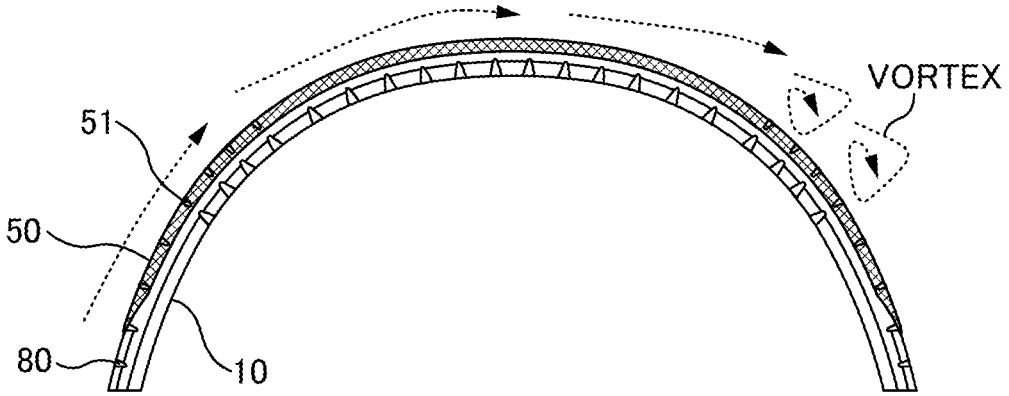
FIG. 12B is a concept diagram illustrating a flow of air at the outside of the frame 10 (with the grommet 50 attached) in the present embodiment.

FIG. 12A is a concept diagram illustrating a flow of air at the outside of the frame 10' of Comparative Example 1. FIG. 12B is a concept diagram illustrating a flow of air at the outside of the frame 10 of the present embodiment (with the grommet 50 attached thereto).

As illustrated in FIG. 12A, in Comparative Example 1, after the airflow has passed sites with a large curvature, the airflow is then liable to separate at the rear half. This results in large vortexes and increases resistance. Similar also applies to Comparative Example 2 (the frame 10").

As illustrated in FIG. 12B, due to providing the projections 80 (and the protrusions 51 of the grommet 50) in the present embodiment in the leading half that includes sites with a large curvature, the projections create turbulent flow within the boundary layer, thereby making the airflow less prone to separating and resulting in smaller vortexes on the downstream side. This thereby enables a reduction in air resistance to be achieved at the frame outer peripheral side in comparison to Comparative Example 1 and Comparative Example 2.

Note that the positions where the projections 80 are provided may be sites with a large curvature, as described above (in other words, sites where the radius of curvature is small). This is because the pressure change at sites with a small curvature is gentler and the airflow is not liable to separate when in the wind, and there is accordingly a low necessity to provide projections 80 thereat. Conversely, the pressure change is sudden at sites with a large curvature and the airflow is more liable to separate when in the wind, leading to large vortexes such as those illustrated in FIG. 12A being generated and an increase in resistance. Thus providing the projections 80 in a range including the sites with a large curvature as in the present embodiment enables separation of airflow to be suppressed, and also enables vortexes to be made smaller, enabling a reduction in air resistance to be achieved.

===Racket Evaluation Test===

Figure 13A:
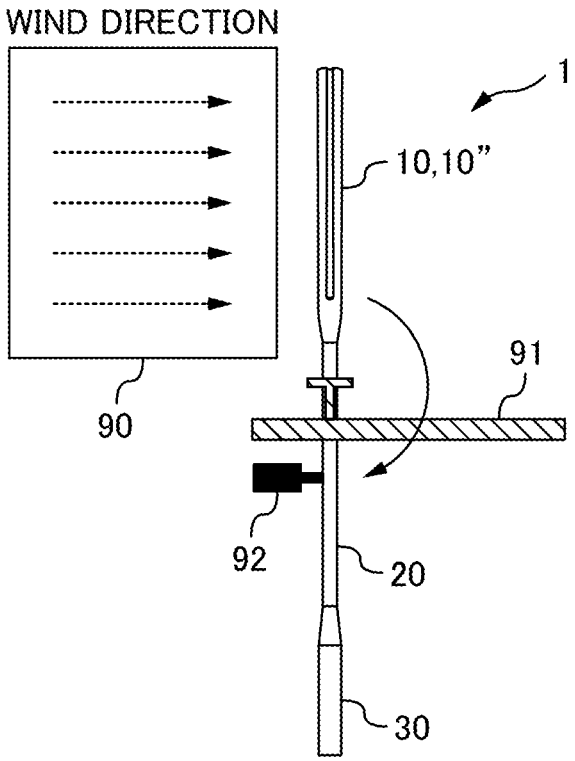
FIG. 13A and FIG. 13B are diagrams to explain a test method to evaluate air resistance acting on the racket 1.
Figure 13B:
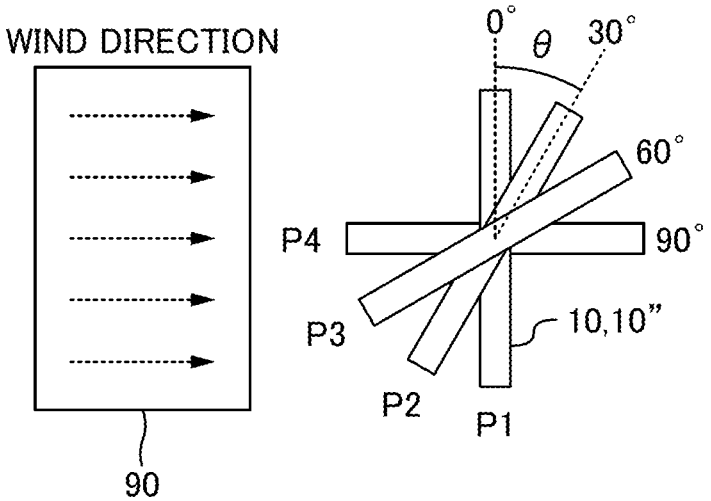
Figures 14A, 14B:
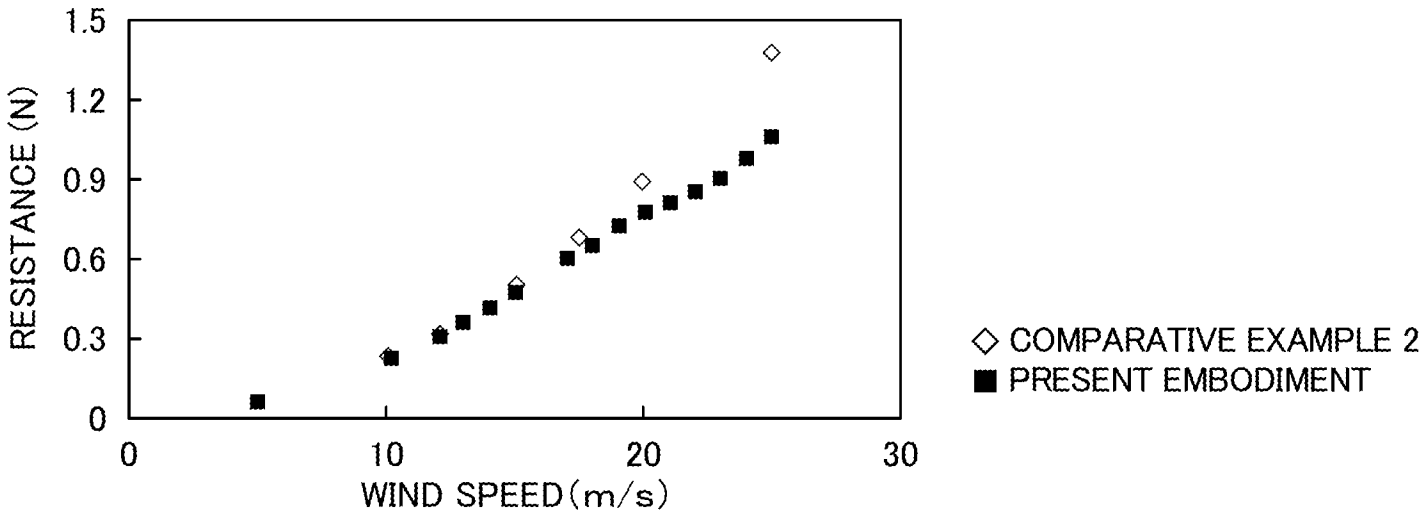
FIG. 14A and FIG. 14B are diagrams illustrating the results of evaluation tests.

FIG. 13A and FIG. 13B are explanatory diagrams illustrating a test method to evaluate air resistance acting on the racket 1. FIG. 13B is a diagram of the racket 1 as viewed from above (from the leading end side thereof). FIG. 14A and FIG. 14B are diagrams showing the results of evaluation tests.

As illustrated in FIG. 13A, equipment for the evaluation test includes a wind tunnel 90, a support stand 91 to support the racket 1 subject to evaluation, and a load cell 92. The wind tunnel 90 blows wind against the entire region of the frame 10 of the racket 1. The support stand 91 supports the frame 10 of the racket 1 such that the racket 1 is capable of pivoting in response to the wind from the wind tunnel 90. The load cell 92 is attached to the upstream side of the racket 1 in the wind direction at a site on the shaft 20 further to the grip 30 side than the pivot point of the racket 1. The load cell 92 measures the force attempting to move the site on the shaft 20 further to the grip 30 side than the pivot point in the opposite direction to the wind direction when the racket 1 is pivoted by the wind from the wind tunnel 90. Namely, the load cell 92 measures the reaction force of the racket 1 to the wind from the wind tunnel 90. The value measured by the load cell 92 is taken as the air resistance acting on the racket 1.

Air resistance was measured using the evaluation test equipment described above for the racket of Comparative Example 2 and for the racket of the present embodiment. Note that position P1 in FIG. 13B, which is one in which a blower outlet of the wind tunnel 90 and the hitting face of the frame are parallel to each other, is taken as a reference position. An angle θ formed between the hitting face of the frame 10, 10" at varying tilts and the hitting face of the frame at the reference position is referred to as the angle of attack. For example, the angle of attack θ is 30° when the frame 10, 10" is at position P2 in FIG. 13B, the angle of attack θ is 60° when the frame 10, 10" is at position P3, and the angle of attack θ is 90° when the frame 10, 10" is at position P4. The air resistance was measured while setting the speed of wind from the wind tunnel 90 and varying the angle of attack of the frame 10, 10" in a range of from 0° to 90°.

First, the air resistance was measured while varying the wind speed in a fixed state of a 15° angle of attack θ between the direction of the wind and the hitting face of the frame. The results are illustrated in FIG. 14A. The horizontal axis in FIG. 14A indicates wind speed (m/s), and the vertical axis indicates air resistance (N).

As the figures illustrate, the rate of increase in resistance declines in the present embodiment from around the 20 m/s wind speed mark, and in comparison to Comparative Example 2, a reduction in air resistance of approximately 20% can be achieved at wind speeds of 23 m/s or greater (corresponding to the swing speed of an ordinary lower-intermediate level player).

Moreover, as illustrated in FIG. 13B, the air resistance was also measured while varying the tilt (the angle of attack θ) of the frame with respect to the direction of the wind. These results are illustrated in FIG. 14B, and are shown as proportional reductions in air resistance of the present embodiment in comparison to the air resistance of Comparative Example 2 for each of the angles of attack θ.

As the figures illustrate, the air resistance was lower overall than Comparative Example 2 in each case, and in particular the results obtained indicate there to be a high air resistance reduction effect for angles of attack θ of from 15° to 30°.

Other Embodiments

The above embodiment modes are to facilitate understanding of this invention, and are not for limiting this invention in any way. It is needless to say that this invention can be changed or modified without deviating from the scope, and this invention includes its equivalents.

For example, although in the embodiment described above a tennis racket is given as an example, there is no limitation thereto. For example, the invention may also be applied to a squash racket, a badminton racket, or the like. Moreover, although in the embodiment described above a racket having strings strung in a frame is given as an example, there is no limitation thereto, and a racket not strung with strings may be employed.

Although in the embodiment described above the projections (the projections 70 and the projections 80) are respectively provided at the inner peripheral side and the outer peripheral side of the frame 10, a configuration lacking the projections 70 at the inner peripheral side may be adopted. For example, the projections 80 may be provided to the outer peripheral face 10*b*' of the frame 10' of Comparative Example 1. Such cases would also enable a reduction in air resistance to be achieved, and higher rigidity to be achieved, in comparison to the frame 10' of Comparative Example 1.

REFERENCE SIGNS LIST

1: racket; 10: frame; 10*a*: inner peripheral face; 10*b*: outer peripheral face; 11: string hole; 12: groove; 20: shaft; 30: grip; 40: string; 41: lateral string; 42: longitudinal string; 50: grommet; 50*a*: base portion; 50*b*: string protection member; 51: protrusion; 52: recess; 70: projection (inner peripheral side); 80: projection (outer peripheral side); 90: wind tunnel; 91: support stand; 92: load cell.

The invention claimed is:

1. A tennis racket comprising:

a grip;

an annular frame;

a shaft coupling the grip and the frame together;

wherein a projection is provided to an outer peripheral face on a leading end half of the frame in a predetermined range including a location of maximum curvature in a peripheral direction;

wherein the projection has a width in the peripheral direction wider at a position at a central side of the projection in a thickness direction, which is orthogonal to a hitting face formed inside the frame, than at a position at an end side of the projection in the thickness direction; and wherein:

a grommet is attached to an outer periphery of the frame; and the grommet includes a recess configured to fit together with the projection of the frame on a back face of the grommet, which is a side of the grommet opposing the frame, and includes a protrusion formed to correspond to the recess on a front face of the grommet, which is the opposite side to the back face.

2. A tennis racket comprising:

a grip;

an annular frame;

a shaft coupling the grip and the frame together;

wherein a projection is provided to an outer peripheral face on a leading end half of the frame in a predetermined range including a location of maximum curvature in a peripheral direction;

wherein the projection has a width in the peripheral direction wider at a position at a central side of the projection in a thickness direction, which is orthogonal to a hitting face formed inside the frame, than at a position at an end side of the projection in the thickness direction;

wherein a height of the projection is 0.5 mm or lower; and wherein:

a grommet is attached to an outer periphery of the frame; and the grommet includes a recess configured to fit together with the projection of the frame on a back face of the grommet, which is a side of the grommet opposing the frame, and includes a protrusion formed to correspond to the recess on a front face of the grommet, which is the opposite side to the back face.

* * * * *